US011780720B2

(12) United States Patent
Lambrecht

(10) Patent No.: US 11,780,720 B2
(45) Date of Patent: Oct. 10, 2023

(54) BEVERAGE AERATION

(71) Applicant: Coravin, Inc., Bedford, MA (US)

(72) Inventor: Gregory Lambrecht, Natick, MA (US)

(73) Assignee: Coravin, Inc., Bedford, MA (US)

( * ) Notice: Subject to any disclaimer, the term of this patent is extended or adjusted under 35 U.S.C. 154(b) by 830 days.

(21) Appl. No.: 15/655,180

(22) Filed: Jul. 20, 2017

(65) Prior Publication Data

US 2019/0002266 A1 Jan. 3, 2019

Related U.S. Application Data

(60) Provisional application No. 62/525,841, filed on Jun. 28, 2017.

(51) Int. Cl.

| | |
|---|---|
| ***A47G 19/22*** | (2006.01) |
| ***B65D 25/08*** | (2006.01) |
| ***B67D 1/08*** | (2006.01) |
| ***B67D 1/00*** | (2006.01) |
| ***B67D 1/04*** | (2006.01) |
| ***B01F 23/232*** | (2022.01) |
| ***B01F 23/2361*** | (2022.01) |

(Continued)

(52) U.S. Cl.

CPC ..... *B67D 1/0885* (2013.01); *B01F 23/232* (2022.01); *B01F 23/2361* (2022.01); *B01F 23/23413* (2022.01); *B01F 25/23* (2022.01); *B01F 25/25* (2022.01); *B01F 33/5011* (2022.01); *B01F 35/71745* (2022.01); *B67D 1/0004* (2013.01); *B67D 1/0412* (2013.01); *B67D 1/0884* (2013.01); *B01F 23/2364* (2022.01); *B01F 2101/17* (2022.01); *B67D 2001/0093* (2013.01); *B67D 2001/0481* (2013.01)

(58) Field of Classification Search

CPC .... B67D 1/0885; B67D 1/0884; B01F 3/0446

See application file for complete search history.

(56) References Cited

U.S. PATENT DOCUMENTS 6,196,525 B1 * 3/2001 Ganan-Calvo .... A61M 15/0065 261/76

8,272,538 B2 9/2012 Weinberg et al.

(Continued)

FOREIGN PATENT DOCUMENTS

CH 652046 A5 10/1985

GB 2 256 636 A 12/1992

(Continued)

OTHER PUBLICATIONS

International Search Report and Written Opinion for International Application No. PCT/US2018/039712, dated Sep. 18, 2018.

(Continued)

*Primary Examiner* — Helena Kosanovic

*Assistant Examiner* — Ahmad Abdel-Rahman

(74) *Attorney, Agent, or Firm* — Wolf, Greenfield & Sacks, P.C.

(57) ABSTRACT

Devices and methods for extraction of a beverage from a beverage bottle, such as a wine bottle, using an extraction device. An aeration nozzle may be used to generate one or more jets of beverage arranged to expose the beverage to ambient air or other surrounding gas.

21 Claims, 12 Drawing Sheets

(51) Int. Cl.

| | |
|---|---|
| ***B01F 23/234*** | (2022.01) |
| ***B01F 25/23*** | (2022.01) |
| ***B01F 25/25*** | (2022.01) |
| ***B01F 33/501*** | (2022.01) |
| ***B01F 35/71*** | (2022.01) |
| *B01F 23/236* | (2022.01) |
| *B01F 101/17* | (2022.01) |

(56) References Cited

U.S. PATENT DOCUMENTS

| | | | | |
|---|---|---|---|---|
| 8,430,023 | B2 | 4/2013 | Hynes | |
| 8,485,503 | B2 | 7/2013 | Lei | |
| 9,181,021 | B2 * | 11/2015 | Manera | B65D 83/32 |
| 2009/0142845 | A1 * | 6/2009 | Benali | G01N 35/08 436/8 |
| 2012/0261844 | A1 * | 10/2012 | Lei | B01F 3/04751 261/119.1 |
| 2013/0255505 | A1 | 10/2013 | Verbicky | |
| 2015/0305548 | A1 * | 10/2015 | Girault | G06K 19/06168 426/231 |
| 2016/0058239 | A1 * | 3/2016 | Bentley | A47J 31/0605 426/433 |
| 2019/0236416 | A1 * | 8/2019 | Wang | G06K 7/1417 |

FOREIGN PATENT DOCUMENTS

| | | | | |
|---|---|---|---|---|
| GB | 2 524 841 | A | 10/2015 | |
| JP | 2006-513937 | A | 4/2006 | |
| JP | 2017-510521 | A | 4/2017 | |
| WO | WO 2004/083102 | A1 | 9/2004 | |
| WO | WO 2005/058744 | A2 | 6/2005 | |
| WO | WO2010071124 | * | 12/2009 | B01F 3/04 |

OTHER PUBLICATIONS

Examination Report for European Application No. 18742886.7, dated Mar. 15, 2022.

* cited by examiner

BEVERAGE AERATION

CROSS REFERENCE TO RELATED APPLICATION

This application claims the benefit of U.S. Provisional Application No. 62/525,841, filed Jun. 28, 2017, which is hereby incorporated by reference in its entirety.

BACKGROUND OF INVENTION

This invention relates generally to the dispensing or other extraction of fluids from within a container, e.g., the dispensing of wine from a wine bottle.

SUMMARY OF INVENTION

One or more embodiments in accordance with aspects of the invention allow a user to dispense or otherwise extract a beverage, such as wine, from within a bottle that is sealed by a cork, plug, elastomeric septum or other closure without removing the closure. In some cases, removal of liquid from such a bottle may be performed one or more times, yet the closure may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage may be introduced into the bottle either during or after extraction of beverage from within the bottle. Thus, in some embodiments, a user may withdraw wine from a wine bottle without removal of, or damage to, the cork, and without allowing air or other potentially damaging gasses or liquids entry into the bottle. However, in some embodiments wine that is actually dispensed from the bottle may be aerated or otherwise have increased exposure to ambient air while being dispensed. In some cases, wine may be dispensed in multiple jets that have a relatively high surface area to cross-sectional area ratio so as to permit ambient air to be dissolved in or otherwise interact with the wine. Such interaction between wine and air is desirable in certain instances, and an aeration device may speed air/wine interaction that would otherwise occur.

In one aspect of the invention, a dispensing device uses gas pressure to expel beverage from a sealed container. An aerator is provided that can be placed in the path of pressurized beverage flow wherein the aerator divides the flow into a multitude of jets. The jets may be provided at the outlet of the dispenser so that the jets are directed to a user's cup or other vessel. The jets may be formed by multiple closed channels that each form a jet without introducing any liquid or gas into the jet.

In one illustrative embodiment, a beverage dispensing device includes a conduit arranged to provide a flow of beverage under pressure to a distal end of the conduit. The conduit may be arranged as a tube or other structure that conducts flow of the beverage. A housing having an inlet may be fluidly coupled to the distal end of the conduit and a flowpath of the housing may extend from the inlet. The housing may engage the conduit by a friction fit, e.g., a seal of the housing may engage the conduit to provide a fluid seal and physical connection, although other arrangement such as a threaded engagement are possible. A plurality of flow channels may each have an inlet end fluidly coupled to the flowpath and extend to an outlet end. Each of the plurality of flow channels may be closed from the inlet end to the outlet end and arranged to receive pressurized beverage from the flowpath at the inlet end to produce a jet of beverage at the outlet end. Thus, in contrast to arrangements that introduce air or other gas by a venturi effect, the flow channels may be arranged to produce the jets without introducing gas into the flow stream until after the jets exit the flow channels.

In one embodiment, the dispensing device may include a source of pressurized gas arranged to deliver pressurized gas into a beverage container, such as a compressed gas cylinder, a pressure regulator and gas delivery tube that operate to deliver pressurized gas into a sealed beverage container. The conduit may be fluidly coupled to the beverage container to receive the flow of beverage under pressure caused by the pressurized gas in the beverage container, e.g., gas pressure in the sealed beverage container may force beverage to flow out of the container and into the conduit under pressure. In one embodiment, a valve may be arranged to control a flow of pressurized gas into the beverage container or to control the flow of beverage under pressure from the beverage container. For example, a valve may be positioned to control flow along the conduit so as to stop or permit the flow of beverage along the conduit. In some cases, a valve may be operable to allow, or prevent, pressurized gas into the container. Gas may be delivered into a container and/or beverage withdrawn from the container by a needle arranged to be inserted through a closure of a beverage container, such as a cork of a wine bottle. The needle may be arranged to deliver the pressurized gas into the beverage container and to deliver beverage under pressure from the beverage container to the conduit. The needle may have two or more lumens, or a single lumen for handling gas and beverage flow, and the needle may be arranged to allow the closure to reseal after the needle is withdrawn.

The flow channels may be arranged in different ways to produce jets of beverage. For example, the jets produced may be arranged in different ways, e.g., the plurality of flow channels may be parallel to each other, diverge from each other, and/or intersect each other. The jets may be arranged in any suitable pattern, e.g., outlet ends of the plurality of flow channels may be arranged in two or more concentric circles or other patterns.

The size of the jets may be arranged in different ways as well. In one embodiment, each of the plurality of flow channels may have a cross-sectional area that is less than a smallest cross-sectional area of the flowpath, and a total cross-sectional area of all of the plurality of flow channels may be less than, or the same as, or greater than, the smallest cross-sectional area of the flow path. In one embodiment, the plurality of flow channels includes at least six flow channels, e.g., 10-30 flow channels, and each of the plurality of flow channels has a diameter of 0.25 mm to 0.75 mm. Each of the plurality of flow channels may have a length of 4 mm to 10 mm, and/or each of the plurality of flow channels may have a length to diameter (or other cross sectional size) ratio of 40:1 to 16:3. This arrangement has been found effective for aerating wine during dispensing, for example. Each of the plurality of flow channels may be tapered so as to have a cross sectional area at the inlet end that is different from a cross sectional area at the outlet end, or each flow channel may have a constant cross-sectional size. The flowpath may include a portion with an increasing cross-sectional area in a direction from the inlet to the plurality of flow channels, e.g., to slow a flow rate of beverage and increase a pressure of the beverage at a point where the beverage enters the flow channels. This may help form suitable jets of beverage.

In one embodiment, an aerator device includes an outer ring having a first outer surface arranged to engage with the housing and a first inner surface defining an opening. An inner ring having a second outer surface may be arranged to be received into the opening and to engage the first inner surface. The first inner surface and/or the second outer surface may include one or more grooves to each define a flow channel. In one example, the inner ring includes a second inner surface that defines a second opening, and a plug having a third outer surface may be arranged to be received into the second opening. The second inner surface and/or the third outer surface may include one or more grooves to each define a flow channel. The grooves may extend from an inlet side of the ring or plug to an outlet side of the ring or plug to form the plurality of flow channels. The mating surfaces of the rings and/or plug may be tapered, e.g., to have a conical shape, or may be cylindrical or have another shape. In one arrangement, a nut may be positioned at an upper side of the outer ring, and the plug may be arranged to engage with the nut, e.g., by a threaded connection, to secure the inner ring and the plug to the outer ring. In some cases, the surfaces of the plug, inner ring and outer ring may be tapered so that engaging the plug and the nut together forces the surfaces of the plug and inner and outer ring together.

In one embodiment, a selector may be attached to the housing and arranged to selectively close or open at least some of the plurality of flow channels. This may allow for adjustment of a number and/or size of jets of beverage that are formed. In one case, the selector includes one or more tabs or slots arranged to selectively block and unblock a flow channel. The selector features may be provided on an inner or outer ring, or a plug as described above.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
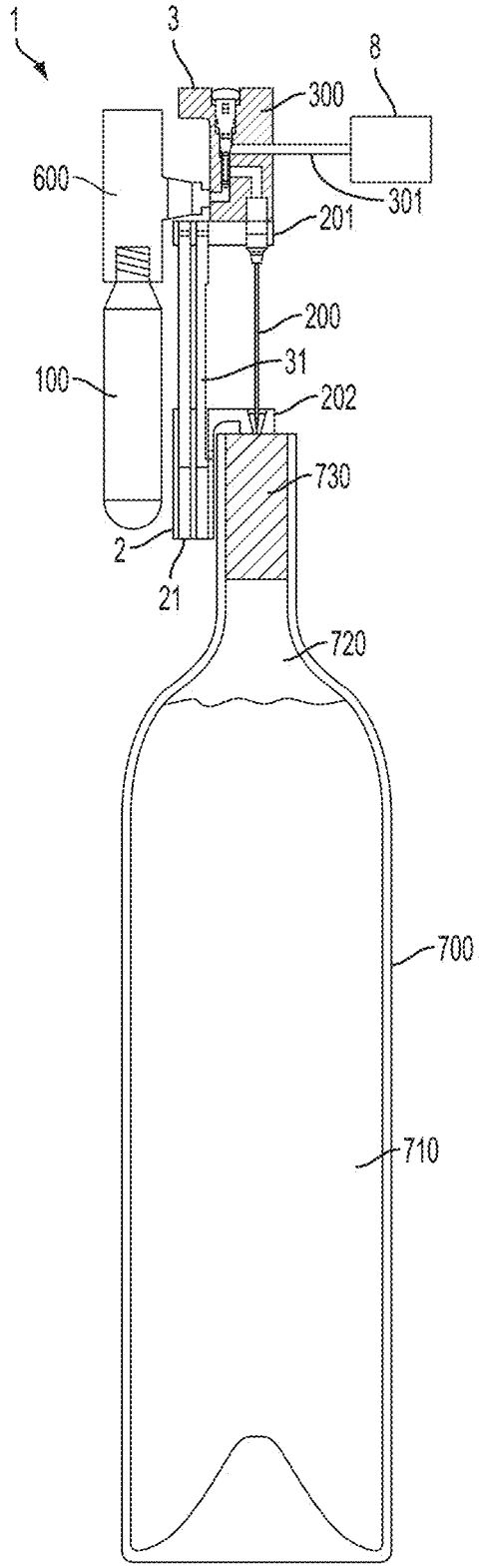
FIG. 1 shows a sectional side view of a beverage extraction device in preparation for introducing a needle through a closure of a beverage bottle.

Aspects of the invention are described below with reference to illustrative embodiments, but it should be understood that aspects of the invention are not to be construed narrowly in view of the specific embodiments described. Thus, aspects of the invention are not limited to the embodiments described herein. For example, embodiments of an aerator nozzle are described as used with a beverage extractor that inserts a needle through a container closure to inject gas into the container and conduct pressurized beverage from the container. However, aerator nozzles are not limited to such applications, and may be used with any type of beverage dispenser. For example, a beverage dispenser need not use a needle that is inserted through a cork, but may instead employ another type of conduit that is passed through a bottle opening after the cork is removed. This is but one alternative, and other dispensing arrangements may be used with an aeration nozzle. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device (or extractor) 1 that may be used in one or more aspects of the invention. This illustrative device 1 includes a body 3 with a source of pressurized gas such as a compressed gas cylinder 100 (e.g., 2600 psi or less as dispensed from the cylinder) and regulator 600. Other sources of pressurized gas may be used, such as a hand bulb, pump, etc. In this arrangement, the cylinder 100 is secured to the body 3 and regulator 600 by a threaded connection, although other configurations are possible, such as those described below and/or in U.S. Pat. Nos. 4,867,209; 5,020,395; and 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the bottle 700 (such as a wine bottle), e.g., so that a pressure established inside the bottle 700 does not exceed a desired level. In other embodiments, no pressure regulation of the gas released from the cylinder 100 need be done, and instead, unregulated gas pressure may be delivered to the bottle 700. In still further embodiments, a flow restrictor such as one or more small orifices or narrow diameter tubes may be used to reduce the pressure from the cylinder 100 rather than a regulator.

In this embodiment, the body 3 also includes a valve 300 operable to control the flow of gas from the regulator 600. The valve 300 may be a 3-way toggle valve that includes a single operation button and functions to selectively introduce pressurized gas into the bottle 700 and extract beverage 710 (such as wine) from the bottle 700 via a needle 200. Details regarding the operation of such a valve 300 are provided in U.S. Pat. No. 8,225,959, which is incorporated by reference in its entirety. Of course, other valve arrangements for controlling pressurized gas and/or beverage flow are possible. For example, the 3-way valve 300 could be replaced with a pair of on/off valves, one for controlling gas introduction to the bottle 700, and another for controlling flow of beverage from the bottle 700. Each valve could have its own actuator, allowing a user to selectively open and close the valves, whether individually or simultaneously. In short, details regarding the operation of the regulator 600 and valve 300 or other mechanisms for introducing gas into a bottle, and removing beverage from the bottle 700 are not necessarily limitations on aspects of the invention and may be modified as suitable.

To introduce gas into the bottle 700 and extract beverage, a needle 200 attached to the body 3 is inserted through a cork or other closure 730 that seals an opening at a neck of the bottle 700. This illustrative device 1 uses a pencil-tip non-coring needle 200 with a needle opening 220 along a sidewall of the needle near the needle tip. While the needle 200 may be inserted into the cork or other closure 730 in different ways, in this embodiment, the device 1 includes a base 2 with a pair of channels 21 that receive and guide movement of respective rails 31 of the body 3. Thus, movement of the body 3 and attached needle 200 relative to the bottle closure 730 may be guided by the base 2, e.g., the body 3 may slide relative to the base 2 to move the needle 200 into/out of the closure 730. In addition, movement of the needle 200 may be guided by a needle guide 202 that is attached to the base 2 and positioned over the closure 730. Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others. Alternatively, the needle could be inserted without guidance, but rather by the hand of the user through the cork. In yet other arrangements, the closure 730 could be removed and replaced with a stopper and conduit of the extraction device 1 to deliver pressurized gas and/or receive beverage from the container.

In some embodiments, the base 2 may be fixed or otherwise held in place relative to the bottle 700, e.g., by a clamp arm, sleeve, strap or other device that engages with the bottle 700. Clamp arrangements in accordance with aspects of the invention are described in more detail below and may be used to temporarily or releasably secure the device 1 to a wine bottle neck. By restraining movement of the base 2 relative to the bottle 700, such an arrangement may help guide motion of a needle 200 relative to the bottle 700 when penetrating a closure 730, or when being withdrawn from the closure 730. Alternately, the bottle 700 may be manipulated by grasping and manipulating the device 1 since the clamp engaging the device 1 to the bottle 700 may securely hold the device 1 and bottle 700 together.

Figure 2:
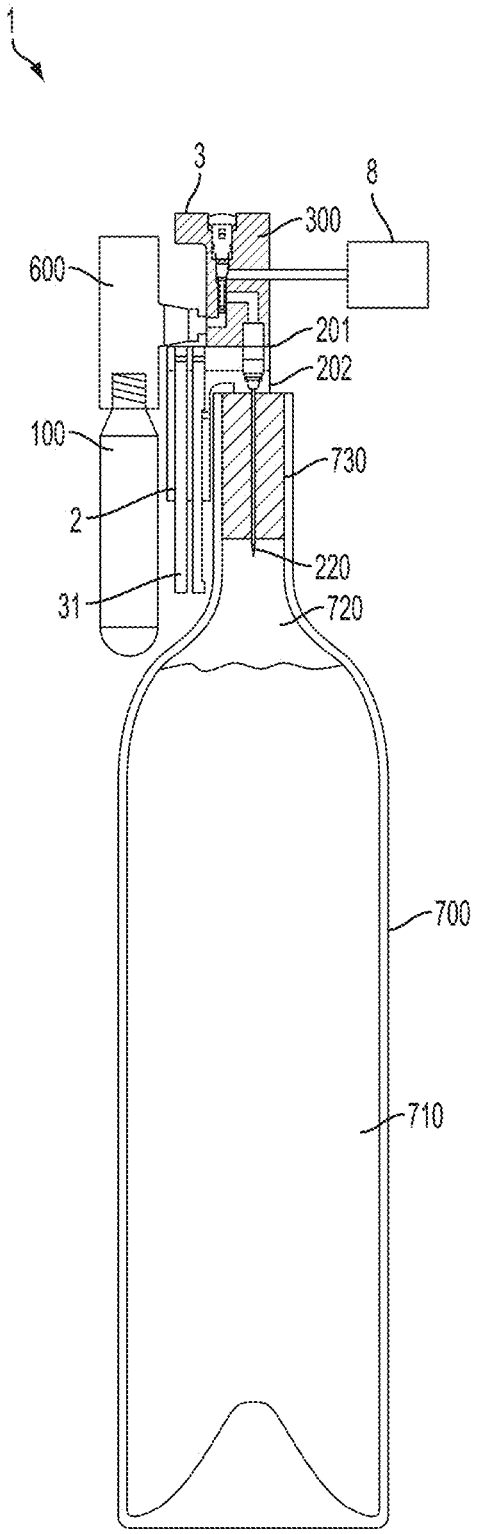
FIG. 2 shows the FIG. 1 embodiment with the needle passed through the closure.
Figure 3:
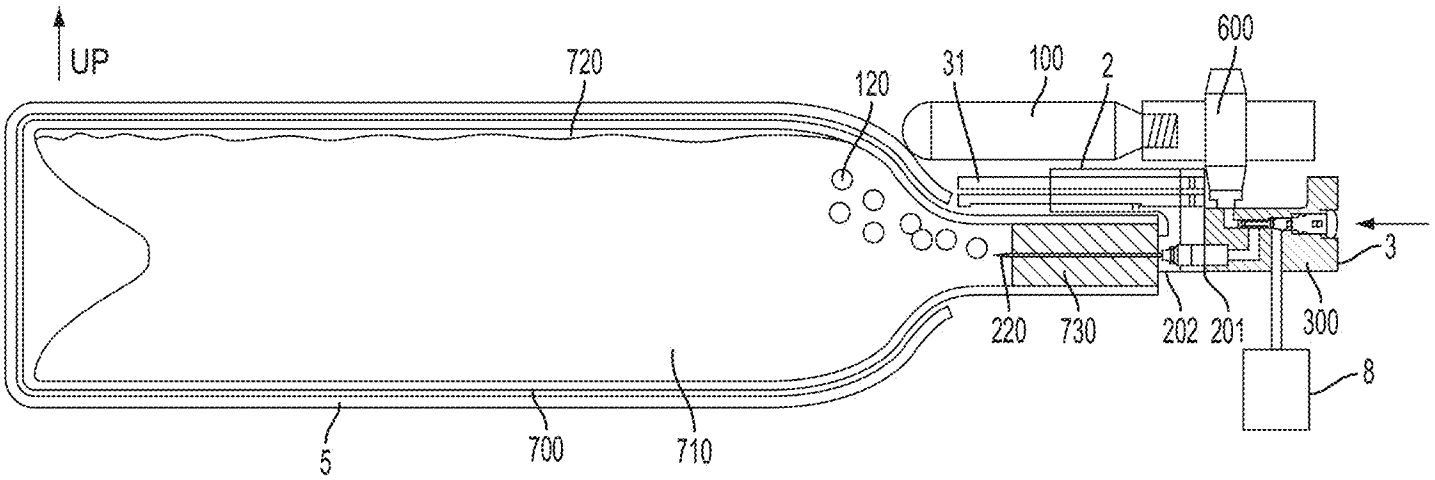
FIG. 3 shows the FIG. 1 embodiment while introducing gas into the bottle.
Figure 4:
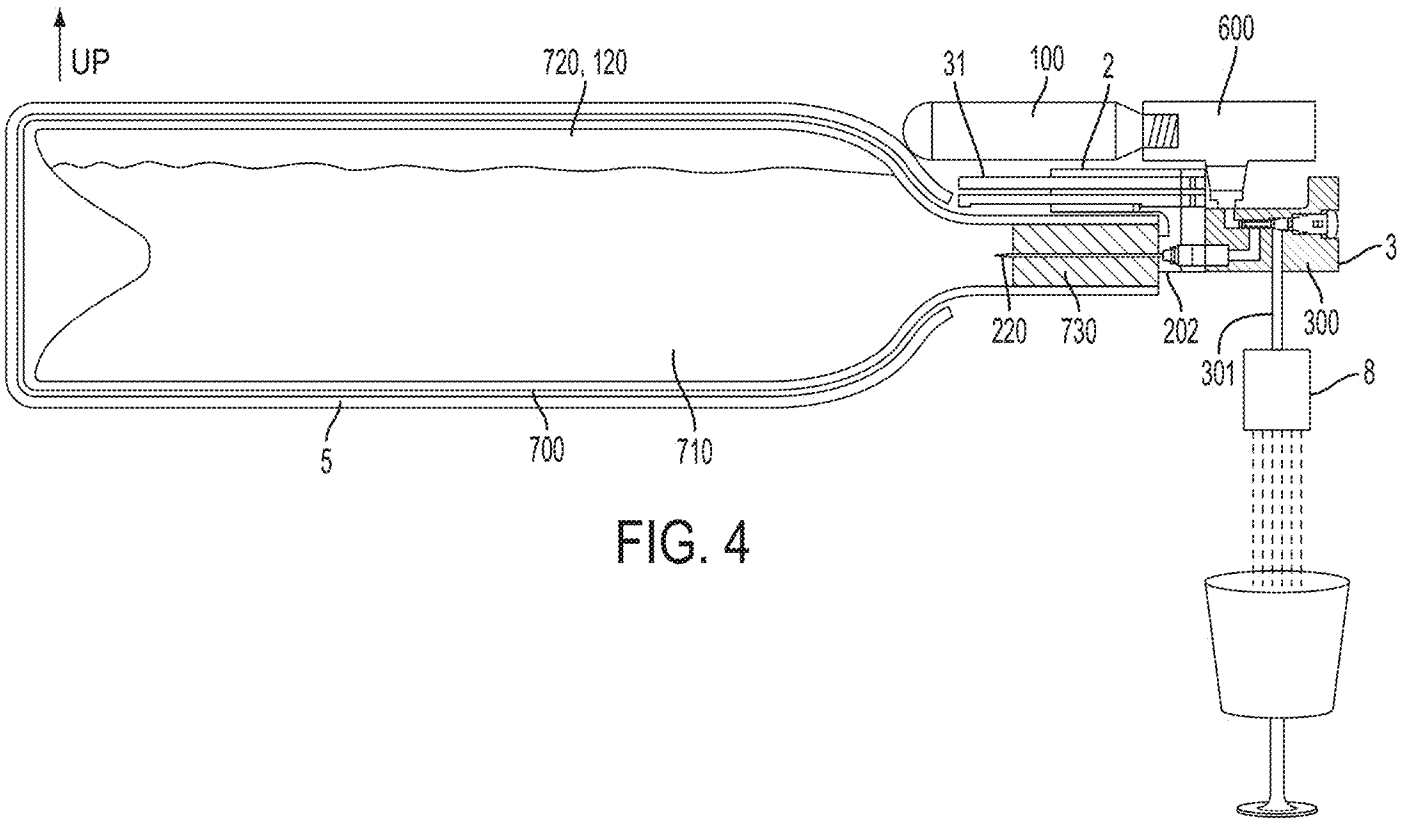
FIG. 4 shows the FIG. 1 embodiment while dispensing beverage from the bottle and employing an aerator nozzle.

To insert the needle 200 through the closure 730, a user may push downwardly on the body 3 while maintaining the base 2 and the bottle 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the bottle 700. The bottle 700 may then be tilted, e.g., so that the beverage 710 flows to near the closure 730 and any air or other gas 720 in the bottle 700 flows away from the closure. Pressurized gas 120 may then be introduced into the bottle 700 by actuating the valve 300 and causing gas from the cylinder 100 to flow through the valve 300 and needle 200 to exit at the needle opening 220, as shown in FIG. 3. Alternately, pressurized gas 120 can be introduced into the bottle 700 prior to tilting of the bottle, followed by tilting and dispensing of beverage. Thereafter, the valve 300 may be operated to stop the flow of pressurized gas and allow beverage 710 to flow into the needle opening 220 and through the needle 200 to be dispensed from the valve 300, as shown in FIG. 4. As shown in FIGS. 3 and 4, the bottle 700 may be at least partially covered by a sleeve or bag 5, which may help support the bottle 700 during dispensing.

As discussed above, in one aspect of the invention, beverage may be dispensed using an aeration nozzle, such as a device that dispenses beverage so as to expose a relatively large surface area per unit volume of beverage to ambient air or other gas and/or a device that actively mixes air or other gas with beverage in the dispensing process. For example, some wines are believed to improve in taste or other characteristics with suitable exposure to air after opening the wine bottle. Aeration nozzles in accordance with aspects of the invention may help expose wine or other beverage to air during dispensing so that suitable aeration of the beverage may occur during dispensing or in a way that helps reduce the time for desired aeration. As used herein, aeration refers to exposure of a beverage to air or other gas (carbon dioxide, oxygen, nitrogen, mixtures of gases, etc.) in such a way that gas reacts in some way with at least portions of the beverage and/or that gas is dissolved in the beverage and/or that gas or other compounds are released from the beverage to the air or other ambient gas environment.

In some embodiments, an aeration nozzle functions to produce multiple jets of beverage, i.e., relatively thin streams of liquid that have a relatively high surface area to cross-sectional area ratio such that the beverage is exposed to air or other gas around the jets. In some embodiments, each jet may have a surface area to cross-sectional area ratio of about 16:1 to 5.3:1, e.g., each jet may have a diameter of about 0.25 mm to 0.75 mm. This is in contrast to a beverage stream created by an extractor 1 like that in FIGS. 1-4 without the use of an aerator, which may produce a stream from the dispensing conduit 301 having a diameter of about 5 mm and a surface area to cross-sectional area ratio of about 0.8. The jets created by a nozzle may be arranged to be parallel to each other, or at some angle relative to each other, e.g., so that at least some jets diverge or intersect at a location away from the aeration nozzle. Intersection of the jets may cause splashing or other disturbance to flow so as to expose the beverage to air or other gas and/or enhance release of materials such as carbon dioxide or sulfur dioxide from the beverage. In addition or alternately, the jets may be arranged to strike a cup or other surface which may cause further exposure of the beverage to air or other gas. A nozzle may create five or more jets, and the jets may be arranged in concentric rings or other patterns. For example, a first set of jets may be arranged in a first ring pattern and a second set of jets may be arranged in a second ring pattern that surrounds the first ring pattern. This arrangement may allow for a relatively compact set of small diameter jets that are effective at aerating a beverage while also minimizing the overall diameter of the jet cluster. Of course, other jet arrangements are possible.

In the illustrative embodiment of FIGS. 1-4, wine is dispensed from the extraction device 1 via a nozzle housing 8 that receives pressurized wine from the outlet conduit 301 and outputs multiple jets of wine into a user's cup or other vessel. The nozzle housing 8 may be arranged to receive wine at a relatively high pressure and output multiple jets that may maintain a laminar flow (e.g., may maintain a generally cylindrical shape) for a distance from the nozzle such as 5 cm or more. Alternately, the jets may have a turbulent flow such that the jets lose a cylindrical or other regular shape at a desired distance from the nozzle housing 8. Such an arrangement may help aerate the wine or other beverage. Collectively, the jets may have a cross-sectional area that is less than the outlet conduit 301 from which the beverage is received. Thus, the jets may each have a flow speed that is higher than the flow speed of beverage in the conduit 301. The relatively high flow speed of the jets may help the beverage travel through a longer airspace from the nozzle housing 8 to the user's cup or other vessel, thereby increasing aeration of the beverage. In other embodiments, the jets may have a relatively low flow speed, e.g., a total cross sectional area of the jets may be greater than the cross sectional area of the conduit, and may be dispensed so as to fall vertically from the nozzle housing 8 to the user's cup. This way, a relatively long travel distance through air may be provided, but with a lower flow speed and therefore greater time of exposure to air as each jet falls to the user's cup. The rate of flow of each jet can be controlled by the diameter of that path forming each, the total number of jets and the pressure driving the flow across the aerator. It may be preferable to use multiple different diameter jets, and/or different numbers of each of a variety of different diameter jets to achieve an optimal result.

Figure 5:
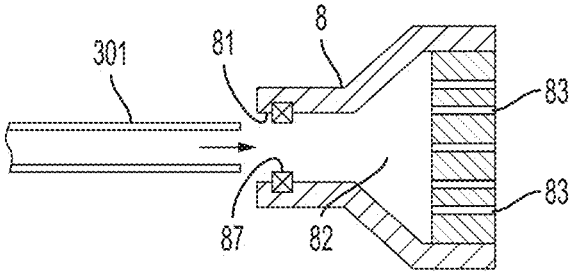
FIG. 5 shows a sectional side view of an aerator nozzle in an illustrative embodiment.
Figure 6:
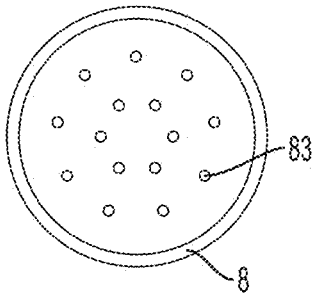
FIG. 6 shows a front view of the aerator nozzle of FIG. 5.

FIG. 5 shows a cross-sectional side view and FIG. 6 a front view of a nozzle housing 8 that may be used with an extraction device 1 like that in FIGS. 1-4 or other beverage dispensers. In this embodiment, the nozzle housing 8 is arranged to be coupled to a conduit 301 arranged to provide a flow of beverage under pressure to a distal end of the conduit 301. In some cases, the conduit 301 may be arranged to dispense wine or other beverage directly to a user's cup without a nozzle housing 8. This may allow a user to dispense wine or other beverage without providing an aeration function during dispensing. However, if aeration is desired, a nozzle housing 8 may be attached to the conduit 301. In this embodiment, the nozzle housing 8 includes an inlet opening that defines an inlet 81 that is fluidly coupled to the distal end of the conduit 301. The nozzle inlet 81 may be coupled to the conduit 301 in different ways, such as by screw thread, interference or friction fit, a bayonet connection, leur-type connection, etc., but in this embodiment engages with the conduit 301 by a friction fit. A seal 87, such as an o-ring or other element, may be provided at the inlet 81 to provide a fluid seal between the housing 8 and the conduit 301, as well as to provide a frictional engagement between the housing 8 and the conduit 301. Alternatively, housing 8 may be at least partially comprised of an elastic material and inlet 81 may be of a slightly smaller diameter than conduit 301, therefore causing a seal between housing 8 and conduit 301 due to compression of housing 8 about conduit 301. Although the housing 8 is shown engaging an exterior of the conduit 301, the housing 8 may engage an interior of the conduit 301 or engage with a butt-type connection. The nozzle housing 8 includes a flowpath 82 that extends from the inlet 81. In this embodiment, the flowpath 82 includes a portion with an increasing cross-sectional area in a direction from the inlet 81 to a plurality of flow channels 83. For example, the flowpath 82 may taper outwardly such that a portion nearer the inlet 81 has a smaller cross-sectional area than a portion nearer the plurality of flow channels 83. This may decrease a flow speed and increase a pressure of beverage at a location near the plurality of flow channels 83, and/or may enable greater separation of each of the flow channels 83, thus reducing the risk that the flow channels will recombine at a given flow speed. In addition, increasing a pressure of beverage as it enters the flow channels 83 may be desirable so as to produce suitable beverage jets from the flow channels 83 because the increased pressure may produce higher speed jets. Though not shown, the flowpath 82 may have features to help create a laminar flow at the flow channels 83, such as one or more baffles, tubular flow elements, etc.

Each of the flow channels 83 may have an inlet end fluidly coupled to the flowpath 82 and extend to an outlet end where beverage in the flow channel 83 exits the nozzle housing 8. Each of the flow channels 83 may be closed from the inlet end to the outlet end, i.e., may not allow fluid flow (including liquid or gas) into or out of the flow channel 83 between the inlet end and the outlet end. Thus, each flow channel 83 may be arranged to receive pressurized beverage from the flowpath 82 at the inlet end and produce a jet of beverage at the outlet end. As noted above, the jets of beverage produced may be formed and directed in a variety of different ways. In this embodiment, the flow channels 83 are arranged in two concentric circular patterns as can be seen in FIG. 6. A first of flow channels 83 is arranged in a first circular pattern, and a second set of flow channels 83 are arranged in a second circular pattern that is arranged around the first circular pattern. This is only one illustrative arrangement, however, and other configurations are possible. For example, the flow channels 83 may be arranged in a random pattern, in non-concentric circular patterns, and others.

As noted above, the jets may be arranged to flow in parallel, to diverge and/or converge so as to intersect after being emitted from the flow channels 83. In some embodiments, a jet integrator may be provided to combine jets into a single flow stream. For example, a funnel-type chamber may be attached to the outlet end of the housing 8 so that beverage jets are emitted from the housing 8, flow through a gas space for at least some distance, and then are routed by the funnel-type chamber so that the jet combine to form a single stream that exits the funnel-type chamber to a user's glass. In one embodiment, the funnel-type chamber may include a cylinder with an open end on a first inlet side, and a tapered section at a second outlet side. The funnel-type chamber may be attached to the housing 8 at the inlet side so that jets are received into a cylindrical space having a diameter approximately equal to a diameter of the housing 8 at its outlet side, and then strike the tapered section at the outlet side after the jets flow through an air space in the cylindrical space. The tapered section may narrow to a relatively small diameter, e.g., 4-5 mm, so that the jets are combined into a single flow stream.

In some cases, each of the flow channels 83 has a cross-sectional area that is less than a smallest cross-sectional area of the flowpath 82, and a total cross-sectional area of all of the flow channels 83 may be less than the smallest cross-sectional area of the flow path 82 and/or of the conduit 301. This may allow the flow channels 83 to produce jets of beverage of a desired flow speed as the jets exit the nozzle housing 8. In one embodiment, the conduit 301 may have a diameter of about 4-5 mm, and the channels 83 may have a diameter of 0.25 to 0.75 mm. Thus, a ratio of the cross sectional area of the conduit 301 to each flow channel 83 may be about 30:1 to 400:1. Also, the ratio of the cross sectional area of the conduit 301 to a total cross-sectional area of all flow channels 83 may be about 1:1 to 20:1, e.g., where about twenty flow channels 83 are provided. In some embodiments, at least six flow channels 83 may be provided, e.g., 10-30 flow channels, and each of the flow channels 83 may have a diameter of 0.25 mm to 0.75 mm. The diameter of the flow channels 83 may remain constant along a length of the flow channel 83, or the flow channels 83 may be tapered or otherwise have a varying diameter or other size. Also, the flow channels 83 need not have a circular cross-sectional shape, but instead may have an elliptical, square, or other desired cross-sectional shape. In some embodiments, the flow channels 83 may have a length that is substantially longer than a diameter or other cross-sectional size. For example, where the flow channels have a diameter of about 0.25 to 0.75 mm, the flow channels may have a length of about 4 mm to 10 mm. Thus, the flow channels 83 may have a length to diameter or other cross-sectional size ratio of 40:1 to 16:3. It has been found that having a relatively higher length to cross-sectional size ratio is beneficial to forming suitable dispensing jets.

Figure 7:
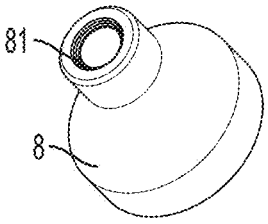
FIG. 7 shows a rear perspective view of an aerator nozzle in another embodiment.
Figure 8:
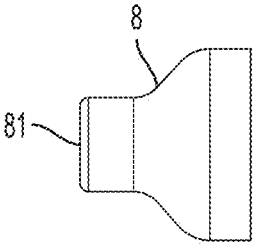
FIG. 8 shows a side view of the aerator nozzle of FIG. 7.
Figure 9:
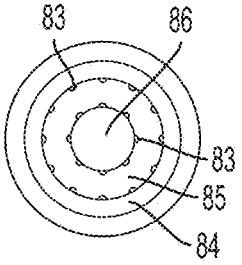
FIG. 9 shows a front view of the aerator nozzle of FIG. 8.
Figure 10:
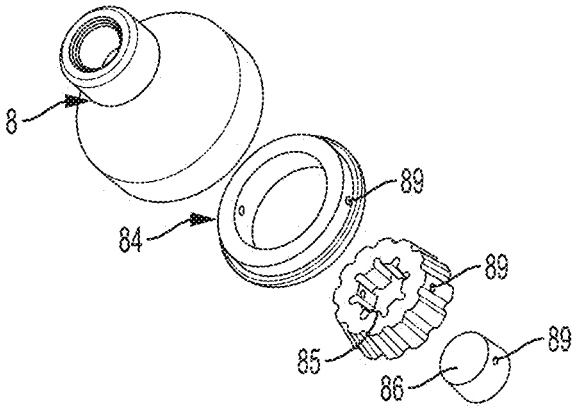
FIG. 10 shows an exploded perspective view of the aerator nozzle of FIG. 7.

In the embodiment of FIGS. 5 and 6, the flow channels 83 are formed as holes or openings through a plate arranged at the outlet of the nozzle housing 8, but other arrangements are possible. For example, FIGS. 7-9 show an embodiment in which flow channels 83 are formed by inner and outer rings 85, 84 and a plug 86. Such an arrangement may avoid the need to form relatively small holes through a plate like that in the FIGS. 5 and 6 embodiment, which can be difficult to do accurately and reliably with some materials and/or at high production volumes. In the FIGS. 7-9 embodiment, flow channels 83 may be formed in a surface of the outer ring 84, and/or a surface of the inner ring 85, and/or a surface of the plug 86. This may relieve manufacturing tolerances or difficulties, and the flow channels 83 may be suitably defined by mating surfaces of the outer and inner rings 84, 85 and/or the plug 86. FIG. 10 shows one illustrative arrangement for the outer and inner rings 84, 85 and plug 86. In this configuration, the outer ring 84 is arranged to snap-fit, threadedly engage or otherwise be secured at an outlet of the nozzle housing 8. The outer ring 84 has a first inner surface that defines an opening and is arranged to receive a second outer surface of the inner ring 85. In this embodiment, the second outer surface of the inner ring 85 includes grooves that define flow channels 83 when the second outer surface is mated with the smooth inner surface of the outer ring 84. Of course, the location of the grooves could be reversed, with grooves on the first inner surface of the outer ring 84 and the second outer surface of the inner ring 85 arranged to be smooth. In other arrangements, both the inner surface of the outer ring 84 and the outer surface of the inner ring 85 may include grooves or other features that define flow channels 83 when the inner ring 85 is mated with the outer ring 84. Such an arrangement may allow for variable size flow channels 83. For example, if the grooves on the outer ring 84 are aligned with the grooves on the inner ring 85, flow channels 83 with a relatively large cross sectional size may be defined. However, if the inner ring 85 is rotated relative to the outer ring 84, the grooves may be unaligned, allowing each groove to define a flow channel 83 having a smaller cross sectional size. Thus, the nozzle 8 may be arranged to provide a first number of beverage jets of a larger size, and a second larger number of beverage jets of a smaller size by adjusting the positions of the inner and outer rings 85, 84.

In this embodiment, the nozzle housing 8 includes a plug 86 that has a third outer surface which is received in a second inner surface of the inner ring 85. Again, flow channels 83 may be defined by grooves or other features in the inner ring 85 and/or the plug 86. In this embodiment, the second inner surface of the inner ring 85 includes grooves that define flow channels when mated with the smooth third outer surface of the plug 86, but the plug 86 may be provided with grooves or other features on its outer surface. Also, any of the outer ring 85, inner ring 84 and plug 86 may include holes or openings that define one or more flow channels 83 without any requirement of being mated with another surface (e.g., in a way like that in FIGS. 5 and 6). The outer ring 84, inner ring 85 and plug 86 may be secured together in different ways, such as by a snap-fit, interference fit, fasteners, adhesive, etc., but in this embodiment each of the outer ring 84, the inner ring 85 and the plug 86 include a hole 89 that extends in a lateral direction, and the holes 89 are arranged to be aligned such that a pin (not shown) is extendable through the holes to secure the outer ring 84, the inner ring 85 and the plug 86 together. The mating surfaces of the outer ring 84, the inner ring 85 and the plug 86 may be cylindrical, or may be tapered. If tapered, the mating surfaces may be tapered so that the surfaces have a conical shape with a larger size near an outlet end of the flow channels 83, or to have a larger size near an inlet end of the flow channels 83. If the surfaces are tapered to have a larger size near the inlet end of the flow channels 83, a securing pin or other structure may not be needed to secure the outer ring 84, the inner ring 85 and the plug 86 together. Instead, the tapered shape of the rings or plug may maintain the parts secured together, at least in one direction.

Figure 11:
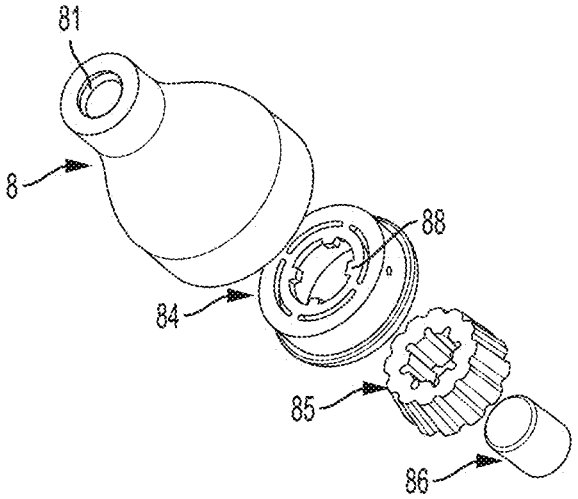
FIG. 11 shows an exploded perspective view of the aerator nozzle in another illustrative embodiment having selector tabs.
Figure 12:
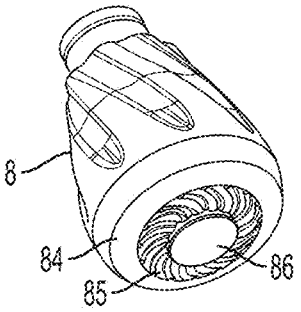
FIG. 12 is a bottom perspective view of an aerator nozzle similar to FIG. 10 but employing a threaded plug and nut engagement.
Figure 16:
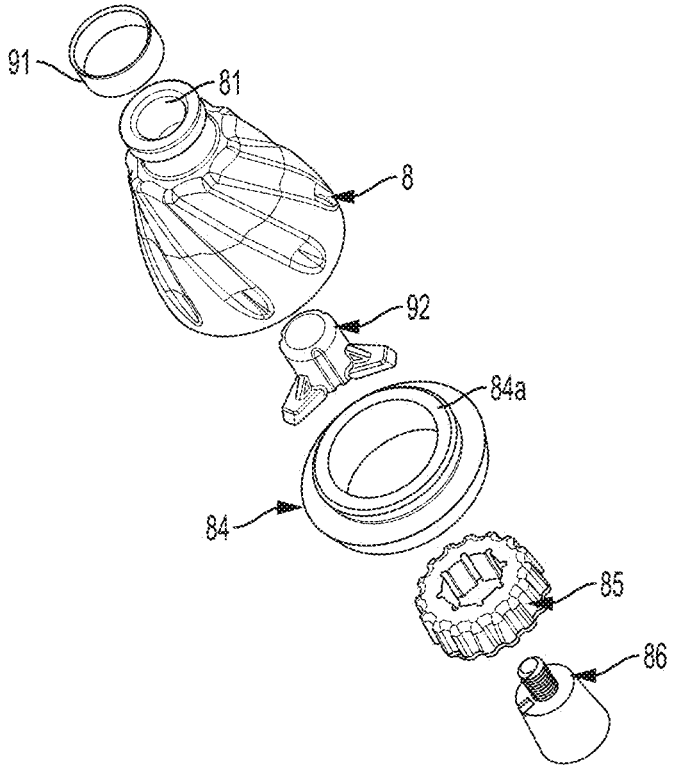
FIG. 16 is an exploded view of the aerator nozzle of FIG. 12.
Figure 13:
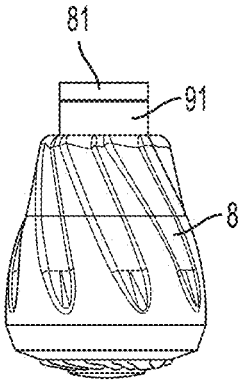
FIG. 13 is a side view of the aerator nozzle of FIG. 12.
Figure 14:
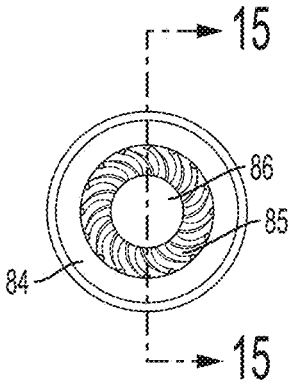
FIG. 14 is a bottom view of the aerator nozzle of FIG. 12.
Figure 15:
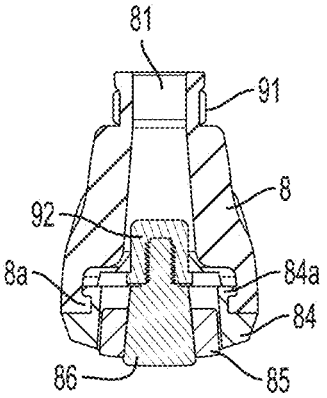
FIG. 15 is a cross sectional view along the line 15-15 in FIG. 14.

FIG. 11 shows another illustrative embodiment that may be employed in the FIGS. 7-9 embodiment. In this arrangement, the outer ring 85 includes a selector 88 that can be used to block or permit flow through one or more flow channels 83. In this embodiment, the selector 88 is arranged as a set of tabs arranged to block one or more flow channels 83 formed between the plug 86 and the inner ring 85, and a set of slots arranged to block one or more flow channels 83 formed between the inner ring 85 and the outer ring 84. That is, by rotating the inner ring 85 relative to the selector 88, one or more flow channels 83 may be blocked or unblocked, thereby adjusting the number of flow channels 83 that form a beverage jet. Rotation of the inner ring 85 relative to the selector 88 may be done in different ways, such as by a knob that is rotated by a user to move the inner ring 85. Alternately, the selector 88 may be made movable relative to the outer ring 84 and may itself be adjusted in position. For example, the selector 88 may be made as a plate positioned at the inlet side of the outer and inner rings 84, 85 and may be rotated by a lever, knob or other feature to suitably position tabs, slots or other structures to open or close flow channels 83.

FIGS. 12-16 show another illustrative embodiment of an aerator nozzle that is arranged in a way similar to that shown in FIG. 10. In this embodiment, the housing 8 is made of, or includes, a resilient or other compliant material at least at the inlet 81. This may allow the housing 8 to engage with an outlet conduit 301 with a friction fit and provide a sealing function. In this embodiment, a ring 91 is also provided at the inlet that is made of a rigid material, such as a plastic or metal. The ring 91 may act as a type of clamp, squeezing radially inwardly on the inlet 81 section of the housing 8 and thereby enhancing the clamping force of the inlet 81 on a conduit 301. The ring 91 may be placed over the inlet portion of the housing 8 prior to engagement of the housing 8 with a conduit 301, or after. In some cases, the ring 91 may be continuous or continuous about its periphery (i.e., form a closed ring or annulus), or may be split in some way so as to be expandable, such as by having an axial cut in the ring 91 or forming the ring 91 with a spiral wrapping of wire or other material. Alternately, the ring 91 may be arranged as a band clamp that can be operated on by a tool to clamp the housing 8 onto a conduit 301.

The FIGS. 12-16 embodiment also includes an outer ring 84, inner ring 85 and plug 86 like that in FIG. 10, but has some modifications. For example, the outer ring 84 in this embodiment includes an annular hook 84*a* that is engaged with an annular lip or tab 8*a* of the housing 8. In one example, the outer ring 84 includes a resilient or compliant material at the hook 84*a* so that the hook 84*a* can be compressed or otherwise deformed so that the hook 84*a* can be engaged with the lip 8*a*. This engagement may secure the outer ring 84 to the housing 8. Also in this embodiment is a nut 92 that is arranged to be positioned on an upper side of the outer ring 84, e.g., in contact with an upper surface of the hook 84*a*, and engage with the plug 86. In this embodiment, the nut 92 includes a threaded portion arranged to engage with a threaded portion of the plug 86 so that the plug 86 can be drawn toward the nut 92 by relative rotation. Since the nut 92 bears on the upper surface of the outer ring 84 and the lip 8*a*, movement of the plug 86 toward the nut 92 draws the plug 86 upwardly into the housing 8. The plug 86 may be rotated relative to the nut 92 by a tool, such as a screwdriver or coin, or by thumb and forefinger. However, other engagement configurations between the plug 86 and nut 92 are possible, such as a bayonet connection, snap fit, a collet connection, etc. In this embodiment, the plug 86 is upwardly tapered (as viewed in FIG. 15) to have a conical shape with a wider diameter near a bottom or outer end of the plug 86. The second inner surface of the inner ring 85 has a complementary taper, e.g., has a conical shape with a wider diameter at a bottom or outlet side. The second outer surface of the inner ring 85 is also tapered to have a conical shape that tapers upwardly, i.e., is wider at a lower or outer side of the inner ring 85, and the outer ring 84 has a complementary taper at its first inner surface. As a result, threading the plug 86 into the nut 92 draws the plug 86 upwardly relative to the outer ring 84, which secures the inner ring 85 relative to the plug 86 and the outer ring 84 due to the interaction of the complementary tapered surfaces. Also, upward movement of the plug 86 may force the inner ring 85 to move upwardly relative to the hook 84*a*, which provides a radially outward force on the first inner surface of the outer ring 84 adjacent the hook 84*a*. This radially outward force may lock the hook 84*a* into engagement with the lip 8*a*, and thus secure all of the outer ring 84, inner ring 85 and plug 86 to the housing 8. In some embodiments, adjusting a tightening force between the plug 86 and nut 92 may adjust a size of the flow channels 83, e.g., a relatively higher force between the plug 86 and nut 92 may squeeze the mating surfaces of the outer and inner rings 84, 85 and plug 86 together, thus narrowing the flow channels 83. Relaxing a tightening force may increase a size of the flow channels 83, and thus adjust the size of beverage jets that are formed.

It should also be understood that an aerator nozzle may be made so that parts of the nozzle can be interchanged to achieve different jet characteristics, such as to change jet diameter or other size, the number of jets formed, a jet flow speed, jet direction, etc. For example, a user may be able to remove the plug 86 and replace the inner ring 85 with another inner ring 85 that causes some change in jet characteristics. Alternately, the plug 86 may be removed and both the inner and outer rings 85, 84 may be replaced. In one embodiment, the outer ring 84 may include a jet re-integrator, e.g., the outer ring 84 may include a cylindrical wall that extends downwardly (as viewed in FIG. 15) so as to provide a cylindrical or otherwise shaped housing around the beverage jets. An outlet side of the outer ring 84 at a distal end of the ring 84 may include a funnel element that causes the jets to be combined together into a single flow stream that exits the outer ring 84 to a user's glass. Of course, such a re-integrator may be separate from the outer ring 84, e.g., may be attached to the housing 8 as discussed above.

Figure 17:
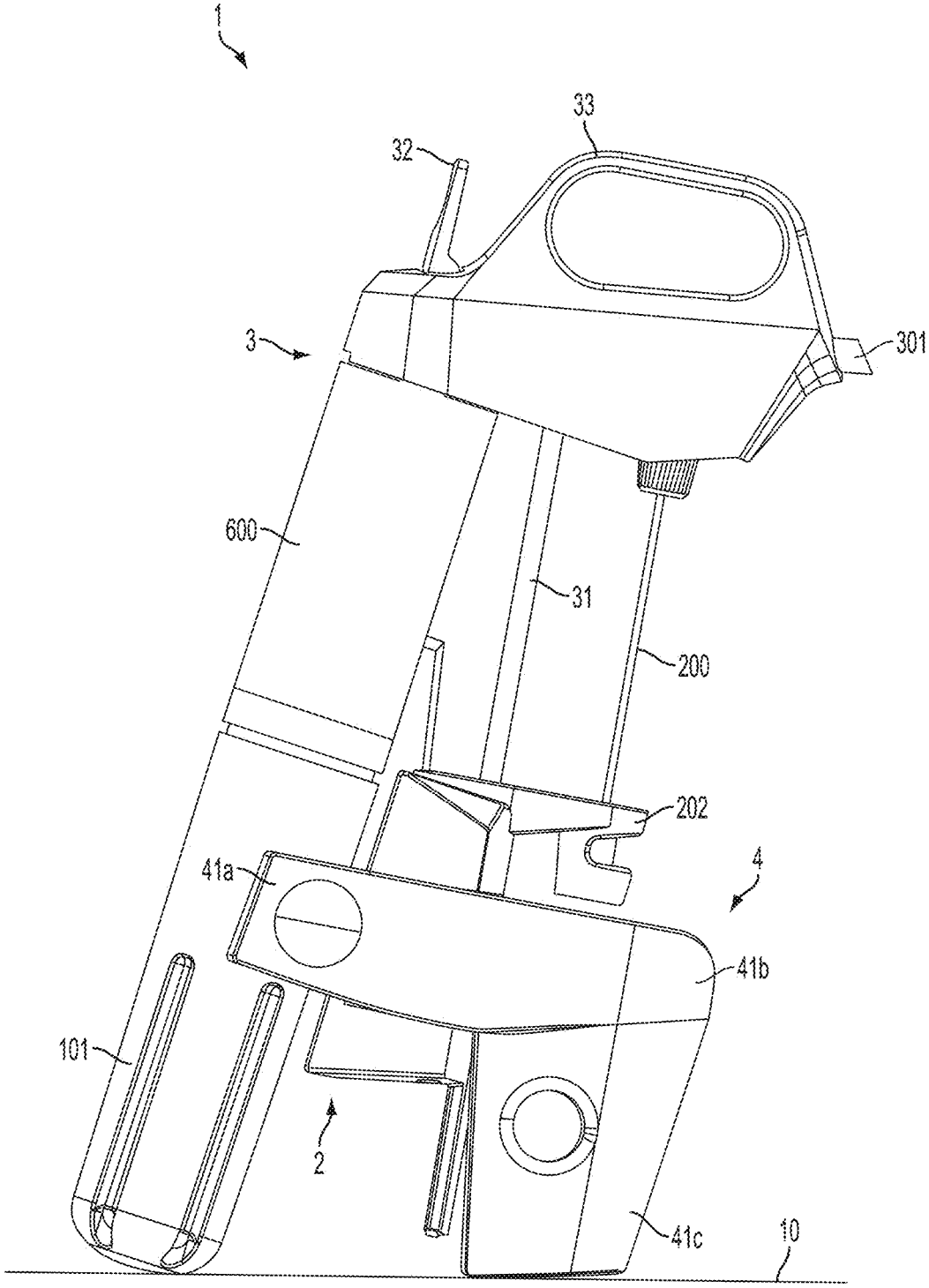
FIG. 17 shows a side view of a beverage extractor in an illustrative embodiment.
Figure 18:
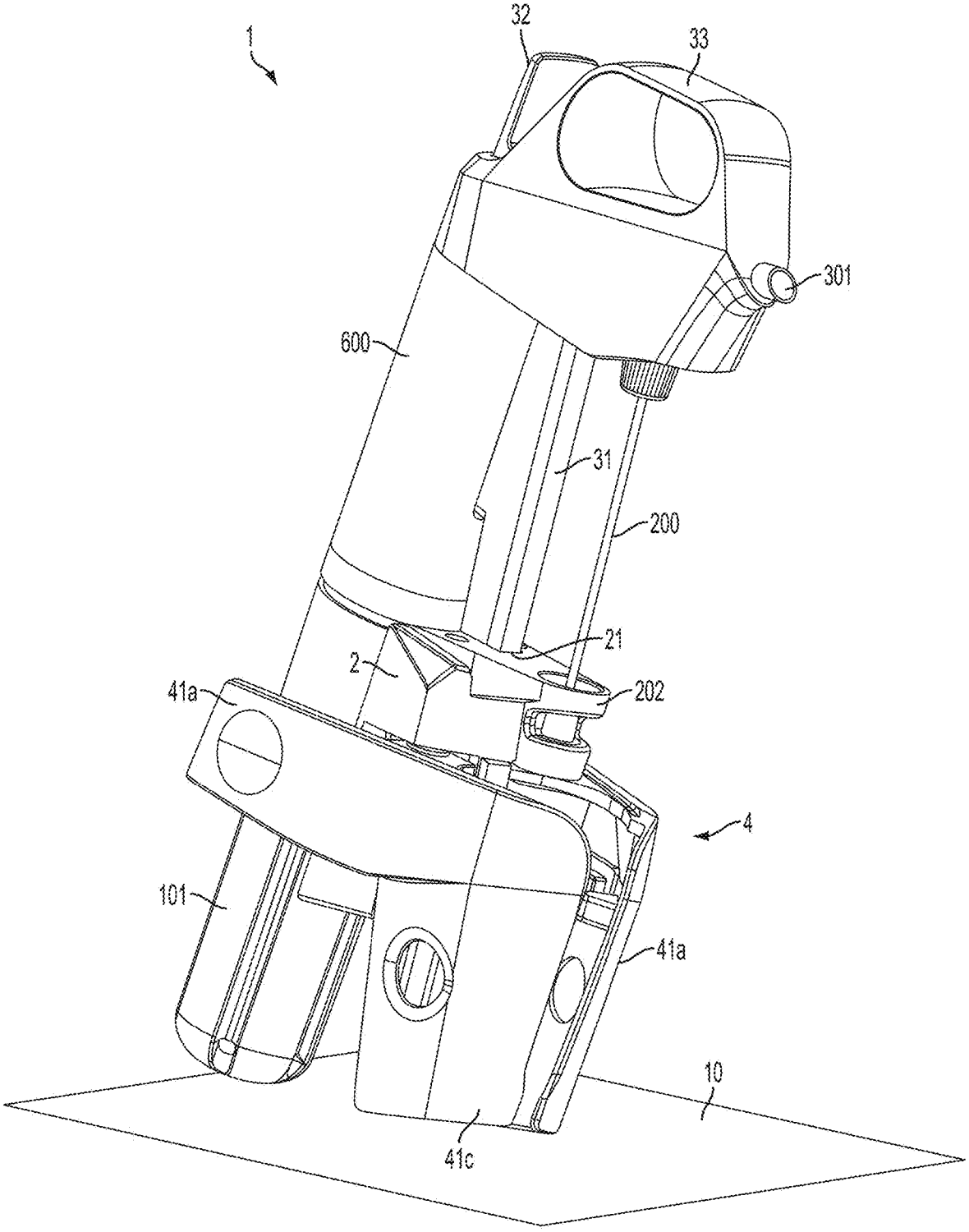
FIG. 18 shows a perspective view of the beverage extractor of FIG. 17.

FIGS. 17 and 18 show an illustrative embodiment of a beverage extraction device 1 that can be used with aspects of the invention. This embodiment is similar in operation to that of FIGS. 1-4, but has a few different features. In this embodiment, the body 3 includes a handle 33, that may be gripped by a user for moving the body 3 relative to the base 2 in upward and downward motions to insert a needle 200 through a cork or other closure of a bottle 700. Also, a lever 32 is provided for operating the valve 300, e.g., to dispense beverage from an outlet conduit 301 and/or deliver gas to the bottle 700 via the needle 200. To allow movement of the body 3 relative to the base 2, the body 3 includes a rail 31 that has T-shaped cross section, and is arranged to move within a T-shaped receiving slot or channel 21 of the base 2. As discussed above, however, other arrangements are possible for engaging the body 3 and base 2 while allowing for movement of the needle 200. Also, a gas cylinder cover 101 threadedly engages with the body 3 at the regulator 600 to engage and hold the cylinder 100 in place relative to the body 3. (A gas cylinder cover 101 in this embodiment is a kind of cap that covers the gas cylinder 100 and threadedly engages with another part of the body 3 to hold the gas cylinder 100 in place.) This arrangement of a gas cylinder cover 101 allows for the use of gas cylinders 100 that do not threadedly engage with the regulator 600, but rather are held in engagement with the regulator 600 by the cover 101.

As discussed above, a beverage extraction device may include a clamp configured to engage the device with a bottle, e.g., by clamping the device to the neck of a bottle. For example, the device can include one or more clamp arms that are movably mounted to the device and are arranged to engage with a bottle to support the device on the bottle during use. The embodiment of FIGS. 17 and 18 has a clamp 4 with a pair of clamp arms 41 that are optionally arranged to support the device 1 in an upright orientation on a flat, horizontal surface 10, such as a table or counter top. (It should be appreciated, however, that a single clamp arm may be provided instead of a pair, as described in more detail below.) In this embodiment, the clamp arms 41 each include a downwardly extending portion 41*c* that contacts the surface 10 along with a lowermost portion of the body 3, which in this example is a lower end of gas cylinder cover 101.

Figure 19:
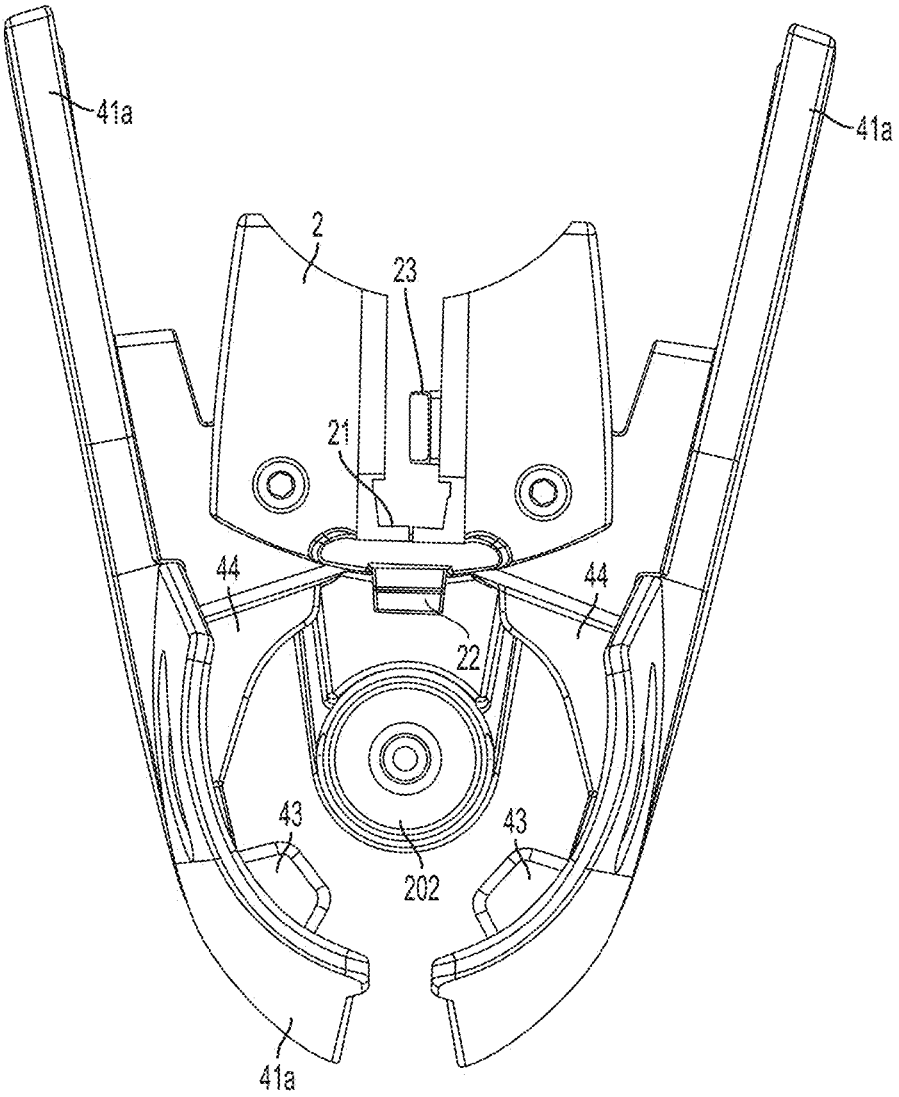
FIG. 19 shows a bottom view of the FIG. 17 embodiment.
Figure 20:
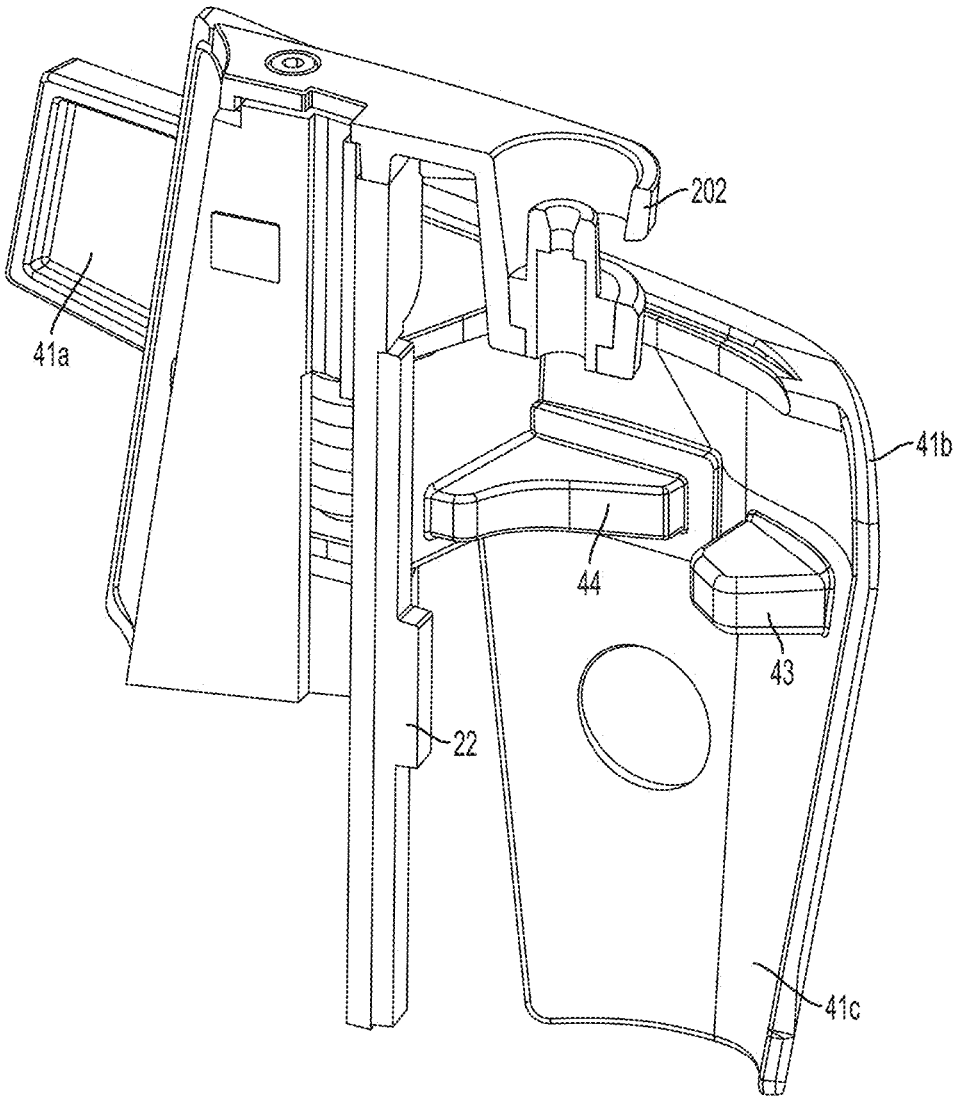
FIG. 20 shows a perspective view of the a clamp arm of the FIG. 17 embodiment.
Figure 21:
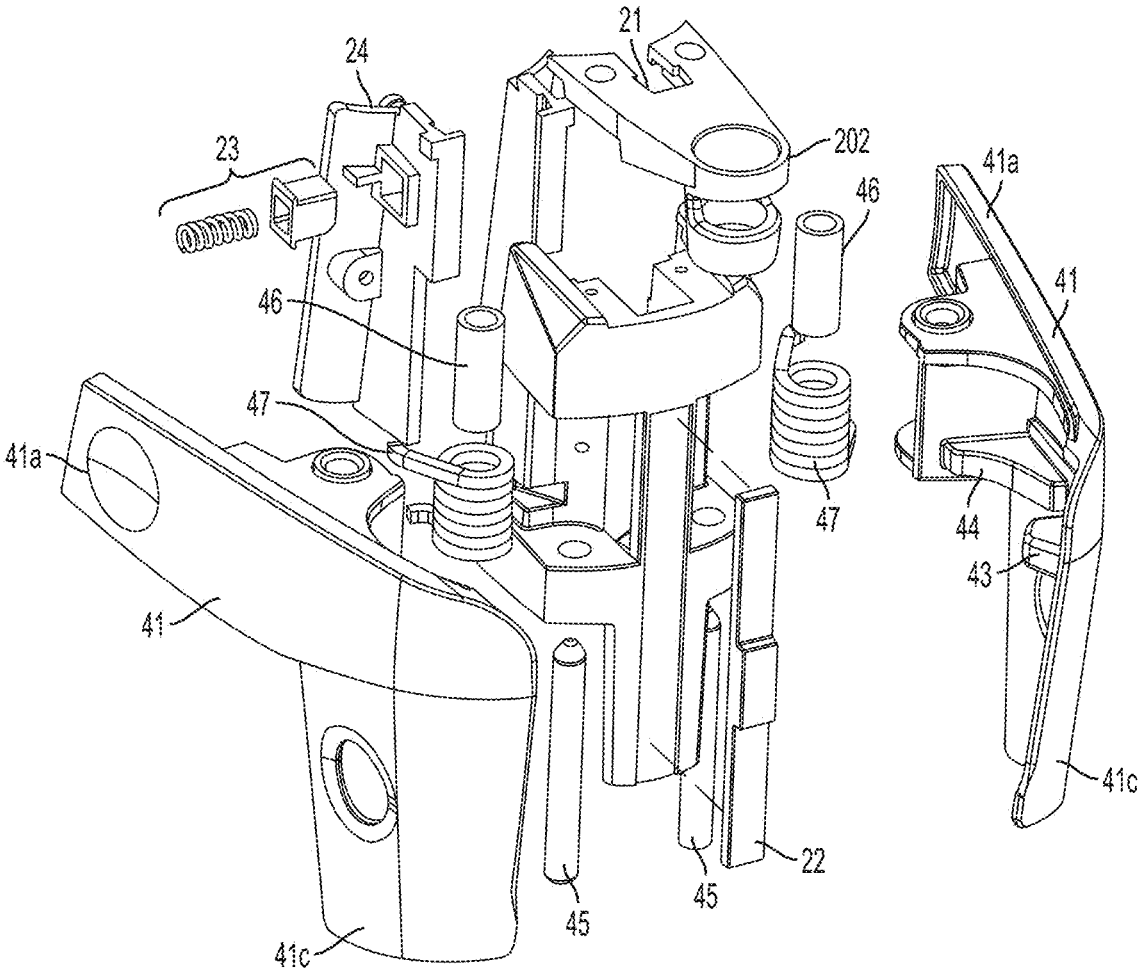
FIG. 21 shows an exploded view of the clamp mechanism of the FIG. 17 embodiment.

The clamp arm(s) may also include a feature to help properly engage the clamp arm(s) with a variety of different bottle necks. For example, different bottles may have different neck diameters, different lip diameters or lengths (as used herein, a lip is a feature of many wine bottles near the top of the neck in which the bottle flares, steps or otherwise protrudes outwardly in size). In one embodiment, the clamp arm(s) include a distal tab feature and a proximal ridge feature that cooperate to properly engage with different neck configurations. FIGS. 19-21 show one illustrative embodiment in which each clamp arm 41 includes a distal tab 43 and a proximal ridge 44. The tab 43 may extend radially inwardly somewhat more than the ridge 44, and thus help to center the bottle neck or otherwise appropriately position the neck relative to the clamp arms 41. For example, as the clamp arms 41 are closed on a neck, the tabs 43 may contact the neck before the ridges 44, helping to center or otherwise appropriately position the neck relative to the device 1. In some embodiments, the tabs 43 and/or the ridges 44 may have portions that contact the bottle neck have a relatively hard, low-friction surface to help allow the clamp arms 41 engage the neck while allowing the neck to shift in position relative to the clamp arms 41. The tabs 43 may help urge the neck proximally relative to the base 2, e.g., to move the neck toward a pad 22 located on the base 2 between the clamp arms 41. By urging the neck to move proximally and into contact with the pad 22 or other component, the clamp arms 41 may help position the neck in a consistent way relative to the needle guide 202 and the needle 200. This may help ensure that the needle 200 penetrates the closure 730 in a desired location. For example, the needle guide 202 and needle 200 may be arranged to pierce a closure 730 in a location that is offset from a center of the closure 730 with the neck positioned in contact with the pad 22. This may help avoid having the needle 200 penetrate the closure in the same location if the device 1 is used two or more times to extract beverage from the bottle 700. (As noted above, beverage can be extracted without removal of the closure 730, and since the closure can reseal after removal of the needle, beverage can be extracted multiple times from a bottle 700 without removal of the closure 730, although the closure 730 may be pierced several times to do so.) Alternately, the needle 200 and guide 202 may be configured to penetrate a closure at its center with the neck in contact with the pad 22, and by positioning the neck proximally and in contact with the pad 22, the closure 730 may be penetrated at the center as desired. In another arrangement in which the device is arranged to penetrate the closure 730 at a center position, the clamp arms 41 may each include semi-circular or other suitably arranged surfaces that contact the neck so the center of the closure 730 is always positioned for penetration by the needle 200.

The ridge 44, though optional, may have a length measured in a direction perpendicular to a bottle neck (or in a direction perpendicular to the length of the needle 200) that is greater than the tab 43, e.g., to help the ridge 43 provide a suitably long contact surface for the lip of the bottle. For example, while the tabs 43 may help center the neck between the clamp arms 41 and urge the neck to move proximally, the ridges 43 may contact an underside of the bottle lip with a suitably long surface to help prevent the neck from moving downwardly relative to the clamp arms 41 more than a desired distance. The extended length of the ridges 44 may provide the ridges 44 with greater strength and help the clamp arms operate with a wide array of bottle neck and lip sizes and shapes. In addition, the ridges 44 may have a variable radial length, e.g., increasing proximally as shown in FIG. 20, to help ensure that the ridges 44 will provide suitable engagement with a variety of different necks having different lip dimensions.

The pad 22 in this illustrative embodiment includes a strip of resilient material, such as a rubber, that can help the device grip the bottle neck when engaged by the clamp arms 41. In some embodiments, the pad 22 may include a protrusion or step near a lower portion of the pad 22 (see FIGS. 19 and 20) so that the pad 22 can engage with a lower surface of a lip on a bottle neck, e.g., similarly to the ridge 44. The pad 22 may extend in a direction along the length of the needle, i.e., along a length of the bottle neck, and may have any suitable length. Generally, however, the pad 22 will have a length that is equal to or shorter than a length of the shortest bottle necks to be engaged by the device 1. Similar is true of the clamp arms 41. That is, the clamp arms 41 may have distal portions 41*b* that extend downwardly, in a direction along the length of the needle 200, to an extent that allows the clamp arms 41 to receive and engage bottles that have a somewhat short neck. In one embodiment, the distal portions 41*b* of the clamp arms 41 may extend downwardly at least to an extent equal to or greater than a lowermost position of the distal end of the needle 200 when the body 3 is positioned at a lowermost position relative to the base 2. In this way, the needle 200 may be prevented from contacting a surface 10 when the device is standing upright on the surface 10. Also, the needle 200 may be movable relative to the clamp arms 41 to be positioned within a space between the clamp arms 41 throughout its full range of movement.

In this illustrative embodiment, the clamp arms 41 are pivotally mounted to the base 2 such that the distal portions 41*b* are normally biased to move toward each other, e.g., to clamp a bottle neck positioned between the arms 41. For example, as shown in FIG. 21, the clamp arms 41 are mounted to the base 2 via pivot pins 45 and bushings 46. However, the clamp arms 41 may be movably mounted relative to the base 2 in other ways, such as by a linkage, living hinge, a sliding engagement (such as by having a portion of a clamp arm move in a channel of the base), and others. Also, one arm may be fixed to the base while the other is made movable (although in this embodiment the arms are still said to be moveable relative to each other). Torsion or other springs may be used to provide the biasing force (if provided at all) on the clamp arms 41. For example, in this embodiment, torsion springs 47 are mounted over the bushings 46 and are arranged to engage the base 2 and a clamp arm 41 so that the clamp arms are biased to move the distal portions 41*b* toward each other. This clamping force of the clamp arms 41 may be sufficiently robust to support the device 1 on the bottle 700, or even to allow a user to lift and pour beverage from the bottle 700 by grasping and manipulating the device 1. The clamp arms 41 may also include proximal portions 41*a* that can be grasped by a user and moved together (overcoming the biasing force of the springs 47) so that the distal portions 41*b* are moved away from each other to receive a bottle neck. For example, in this embodiment, a user may pinch the proximal portions 41*a* together to position a bottle neck between the distal portions 41*b*, and then release the proximal portions 41*a* to allow the clamp arms 41 to clamp the bottle neck. However, other arrangements are possible. For example, the distal portions 41*b* may instead be biased to move away from each other and move toward each other when a user applies suitable force, e.g., to the distal portions 41*b*, to overcome the biasing force. In another embodiment, the clamp arms 41 need not be spring biased at all. In such arrangements where the clamp arms 41 are biased to move the distal portions 41*b* apart or are not biased at all, a locking mechanism may be used to engage the clamp arms 41 to the bottle.

That is, whether the clamp arms 41 are spring biased or not, movement of the arms may be restricted or otherwise controlled in some way by a locking mechanism. For example, the arms 41 may be secured together by a ratchet and pawl mechanism that allows the distal portions 41*b* of the clamp arms 41 to move freely toward each other, but prevents movement of the distal portions 41*b* away from each other unless the pawl is first cleared from the ratchet. This arrangement may allow a user to securely clamp the arms 41 onto a bottle neck with the ratchet and pawl ensuring that the arms 41 will not move away from each other to release the neck until the user releases the pawl. In other embodiments, the arms 41 may be secured against movement away from each other in alternate ways, such as by a buckle and strap (with the strap secured to one arm 41 and the buckle secured to the other arm 41), a screw and nut (in which the screw engages one arm 41, the nut engages the other arm 41, and the screw and nut threadedly engage each other to secure the arms 41 together), a hook-and-loop closure element that spans across the arms 41 at their distal end, or other arrangement suited to engage the arms 41 with the bottle 700.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A beverage dispensing device for dispensing wine, comprising:

a conduit arranged to provide a flow of wine under pressure to a distal end of the conduit;

a housing having an inlet fluidly coupled to the distal end of the conduit and a flowpath extending from the inlet;

an outer ring attached to the housing and having a first inner surface defining an opening;

an inner ring having a second outer surface received in the opening and engaged with the first inner surface and a second inner surface that defines a second opening;

a plug having a third outer surface received into the second opening; and a plurality of flow channels each defined between the first inner surface and the second outer surface and by a groove on the first inner surface or the second outer surface, each flow channel having an inlet end fluidly coupled to the flowpath and extending to an outlet end, each of the plurality of flow channels being closed from the inlet end to the outlet end and configured to receive pressurized wine from the flowpath at the inlet end and to produce a jet of wine at the outlet end to travel from the outlet end through ambient air toward a user's cup;

wherein the second inner surface or the third outer surface includes one or more grooves to each define a flow channel between the second inner surface and the third outer surface.

2. The device of claim 1, further comprising a source of pressurized gas arranged to deliver pressurized gas into a beverage container, wherein the conduit is fluidly coupled to the beverage container to receive the flow of wine under pressure caused by the pressurized gas in the beverage container.

3. The device of claim 2, further comprising a valve arranged to control a flow of pressurized gas into the beverage container or to control the flow of wine under pressure from the beverage container.

4. A beverage dispensing device for dispensing wine, comprising:

a conduit arranged to provide a flow of wine under pressure to a distal end of the conduit;

a housing having an inlet fluidly coupled to the distal end of the conduit and a flowpath extending from the inlet;

a ring attached to the housing and having an inner surface and an outer surface that each have a plurality of grooves formed along the inner surface and the outer surface to define a plurality of flow channels each having an inlet end fluidly coupled to the flowpath and extending to an outlet end, each of the plurality of flow channels being closed from the inlet end to the outlet end and configured to receive pressurized wine from the flowpath at the inlet end and to produce a jet of wine at the outlet end to travel from the outlet end through ambient air toward a user's cup, the inner surface defining an opening;

a plug received in the opening and secured to the housing;

a source of pressurized gas arranged to deliver pressurized gas into a beverage container, wherein the conduit is fluidly coupled to the beverage container to receive the flow of wine under pressure caused by the pressurized gas in the beverage container;

a valve arranged to control a flow of pressurized gas into the beverage container or to control the flow of wine under pressure from the beverage container; and a needle arranged to be inserted into a beverage container to deliver the pressurized gas into the beverage container and to deliver wine under pressure from the beverage container to the conduit.

5. The device of claim 1, wherein the flowpath includes a portion with an increasing cross-sectional area in a direction from the inlet to the plurality of flow channels.

6. The device of claim 1, wherein the second outer surface and the second inner surface each include a plurality of grooves that extend from an inlet side of the inner ring to an outlet side of the inner ring to form the plurality of flow channels.

7. The device of claim 6, wherein the second outer surface and the second inner surface each have a conical shape.

8. The device of claim 1, further comprising a nut positioned at an upper side of the outer ring, wherein the plug is arranged to engage with the nut to secure the inner ring and the plug to the outer ring.

9. The device of claim 1, wherein the outer ring or the inner ring includes one or more tabs arranged to selectively block and unblock a flow channel.

10. The device of claim 1, wherein the housing includes an inlet opening to define the inlet, and a seal arranged in the inlet opening to sealingly engage with an outer surface of the conduit.

11. The device of claim 1, wherein the plurality of flow channels are arranged to produce a plurality of jets of wine that are parallel to each other.

12. The device of claim 1, wherein the outlet ends of the plurality of flow channels are arranged in at least two concentric circles.

13. The device of claim 1, wherein the plurality of flow channels are arranged such that jets of wine intersect at a location positioned away from the outlet ends of the plurality of flow channels.

14. The device of claim 1, wherein the plurality of flow channels are arranged to produce a plurality of jets of wine, wherein at least a portion of the jets diverge from one another.

15. The device of claim 1, wherein each of the plurality of flow channels has a cross-sectional area that is less than a smallest cross-sectional area of the flowpath, and a total cross-sectional area of all of the plurality of flow channels is equal to or greater than the smallest cross-sectional area of the flow path.

16. The device of claim 1, wherein each of the plurality of flow channels has a cross-sectional area that is less than a smallest cross-sectional area of the flowpath, and a total cross-sectional area of all of the plurality of flow channels is less than the smallest cross-sectional area of the flow path.

17. The device of claim 1, the plurality of flow channels includes at least six flow channels, and each of the plurality of flow channels has a diameter of 0.25 mm to 0.75 mm.

18. The device of claim 17, wherein each of the plurality of flow channels has a length of 4 mm to 10 mm.

19. The device of claim 1, wherein each of the plurality of flow channels has a length to diameter ratio of 40:1 to 16:3.

20. The device of claim 1, wherein each of the plurality of flow channels is tapered so as to have a cross sectional area at the inlet end that is different from a cross sectional area at the outlet end.

21. The device of claim 1, further comprising a selector attached to the housing and arranged to selectively close or open at least some of the plurality of flow channels.

* * * * *